US006082873A

United States Patent [19]

Schmidt

[11] Patent Number: 6,082,873

[45] Date of Patent: Jul. 4, 2000

[54] CONNECTING ACCESSORY FOR FLUORESCENT LAMPS

[75] Inventor: Claus Schmidt, Stockdorf, Germany

[73] Assignee: Patent-Treuhand-Gesellschaft fuer elektrische Gluehlampen mbH, Munich, Germany

[21] Appl. No.: 09/116,098

[22] Filed: Jul. 15, 1998

[30] Foreign Application Priority Data

Jul. 22, 1997 [DE] Germany ..... 197 31 276

[51] Int. Cl.[7] ..... F21L 3/00

[52] U.S. Cl. ..... 362/217; 362/256; 362/257; 362/260; 362/279

[58] Field of Search ..... 362/217, 256, 362/257, 260, 279

[56] References Cited

U.S. PATENT DOCUMENTS 4,379,102 4/1983 Kertscher ..... 264/40.7

5,088,015 2/1992 Baggio et al. ..... 362/217

FOREIGN PATENT DOCUMENTS

4407470A1 9/1995 Germany .

*Primary Examiner*—Cassandra Spyrou
*Assistant Examiner*—Mohammad Y. Sikder
*Attorney, Agent, or Firm*—Carlo S. Bessone

[57] ABSTRACT

The present invention relates to a connecting accessory 10 for fluorescent lamps, comprising two lampholders 16 constructed separately from one another and mutually spaced for holding the corresponding connecting ends of the fluorescent lamp 14. In this case, the lampholders 16 are each arranged in a holder receptacle 18. Moreover, the holder receptacles 18 each have an integrated device for the strain relief of electric connecting lines 22 leading to a ballast or coming therefrom.

8 Claims, 4 Drawing Sheets

CONNECTING ACCESSORY FOR FLUORESCENT LAMPS

BACKGROUND OF THE INVENTION

The present invention relates to a connecting accessory for fluorescent lamps, comprising two lampholders constructed separately from one another and mutually spaced for holding the corresponding connecting ends of the fluorescent lamp, the lampholders being arranged in each case in a holder receptacle.

Known built-in lampholders for linear fluorescent lamps, for example, comprise a mounting member which is constructed in one piece and holds both the lampholder for the connecting ends of the fluorescent lamp and the required ballast. Such mounting members have the disadvantage, however, that different mounting members are required for each length of fluorescent lamp. It is therefore impossible for such mounting members constructed in one piece to be used flexibly for different fluorescent lamps.

It has therefore been attempted to construct the lampholders to hold the connecting ends of the fluorescent lamps independently of one another, and to space them mutually in an appropriate fashion. Thus, use is and has been made of simple metal angles, one surface of which is arranged by means of a screw fixing on an appropriate mounting surface, for example the ceiling or wall of a living room, while the surface at an angle thereto holds the lampholder. The ballast is arranged separately. Although this connecting accessory can now be used for fluorescent lamps having different lengths and also different powers, enormous problems arise disadvantageously in mounting corresponding connecting accessories. In particular, a problem arises in the strain relief of the electric connecting lines used. In addition, the elements used must be grounded, in order thus to be able to ensure the operating safety required.

In the case of such known connecting accessories, it is necessary in accordance with the safety class I as defined in DIN 60598, Part 1 "luminaires" to provide an additional connecting point for a protective conductor to which it is necessary to connect all touchable metal parts which can directly acquire voltages in the case of a fault. This also considerably limits the possibilities of use for such connecting accessories.

In addition to the known connecting accessories based on metal angles, there is also known from DE4407470A1 a connecting accessory for fluorescent lamps having electronic ballasts, in the case of which the metal angles are replaced by holders arranged in two head pieces. The electronic ballast is accommodated in this case in one of the two head pieces. The above-named problems and disadvantages also occur in the case of this connecting accessory known from the prior art.

SUMMARY OF THE INVENTION

It is the object of the present invention to provide a connecting accessory of the type mentioned at the beginning which overcomes said disadvantages and can be used in a versatile way and in so doing ensures that mounting is simple.

The features of the independent claim serve to achieve this object.

Advantageous embodiments are described in the subclaims.

The inventive connecting accessory for fluorescent lamps has holder receptacles which each have an integrated device for the strain relief of electric connecting lines leading to a ballast or coming therefrom. This ensures that it is possible to dispense with the intensive work normally carried out by the fitter to fix the connecting lines, and thus that the inventive connecting accessory can be mounted simply, reliably and quickly independently of the position of the ballast. By virtue of the fact that in the case of the connecting accessory according to the invention the holder receptacle comprises only the actual lampholder and the device for strain relief, the latter can be kept small, and this ensures its flexible use in mounting, and the most varied possibilities of use. In addition, the inventive design of the connecting accessory renders it possible for the electric connecting lines to be guided differently, and this in turn permits the most varied possibilities of use.

In an advantageous embodiment of the invention, the holder receptacles each consist of a base element for holding the device for strain relief and a mounting frame for mounting the lampholder. In this case, the base element and the mounting frame are generally arranged perpendicular to one another. However, they can also be constructed one behind another. This design, which is simple and reduced to the essentials, of the holder receptacle ensures that the connecting accessory according to the invention is of low overall size. In a further advantageous embodiment of the inventive connecting accessory for fluorescent lamps, the device for strain relief has means for fixing the electric connecting lines in a clamping fashion. Said means advantageously comprise at least two mutually spaced strips. In this case, the electric connecting lines leading to the lampholder inside the holder receptacle are guided in such a way that they come to lie between said means and are thereby relieved of strain.

In a further advantageous embodiment of the invention, the holder receptacles each have a housing cover, the housing cover being constructed in such a way that it covers the lampholder and the lamp base. In addition, the electric connecting lines each have double or reinforced insulation. It is ensured thereby that luminaires in which the inventive connecting accessory is used fulfils the requirements of safety class II in accordance with DIN 60598, Part 1 "luminaires". It is thus possible to dispense with additional connecting points for protective conductors, as a result of which the mounting of the luminaire is further simplified and the size of the luminaire can likewise be reduced overall. The inventive design of the connecting accessory also results in lower production costs.

BRIEF DESCRIPTION OF THE DRAWINGS

Further details, advantages and features of the invention follow from the description given below of the exemplary embodiment represented in the drawings, in which.

BEST MODE FOR CARRYING OUT THE INVENTION

Figure 1:
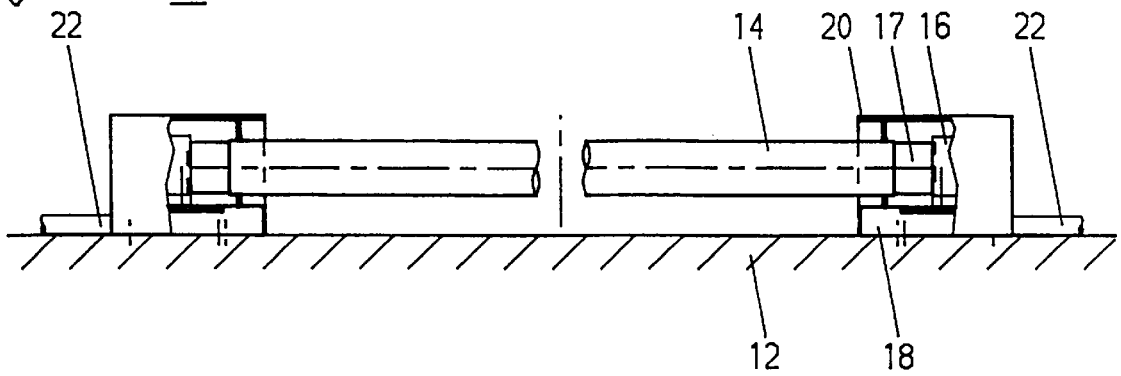
FIG. 1 shows a diagrammatically represented side view of the connecting accessory according to the invention.

FIG. 1 shows a diagrammatic lateral representation of a connecting accessory 10 for fluorescent lamps. The connecting accessory 10 comprises in this case two lampholders 16 constructed separately from one another and mutually spaced for holding the corresponding connecting ends of the fluorescent lamp 14. The lampholders 16 are each arranged in this case in a holder receptacle 18 and usually constructed resiliently. The holder receptacles 18 are mounted on a corresponding mounting surface 12. It may be seen, furthermore, that the holder receptacles also each have a housing cover 20. The housing cover 20 is constructed in this arrangement in such a way that it covers the lampholder 16 and a lamp base 17. The housing cover 20 therefore serves additionally to provide shock protection. Electric connecting lines 22 enter the holder receptacles 18 at the ends of the holder receptacle 18 remote from the fluorescent lamp 14. The electric connecting lines 22 lead in this case to a ballast (not represented), or come from there.

Figure 2:
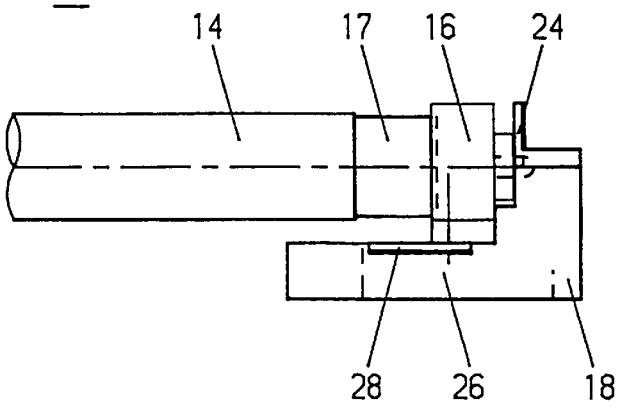
FIG. 2 shows a diagrammatically represented side view of a holder receptacle of the connecting accessory according to the invention.

FIG. 2 shows a diagrammatically represented side view of the holder receptacle 18. It may be seen that the holder receptacle 18 comprises a base element 26 for holding the device for strain relief 38 (compare FIGS. 3 and 4) and a mounting frame 24 for mounting the lampholder 16. The base element 26 and the mounting frame 24 are arranged perpendicular to one another in this case. The base element 26 also has laterally arranged projections 28 which correspond to appropriately constructed grooves inside the housing cover 20 and serve to mount the housing cover 20 on the holder receptacle 18.

Figure 3:
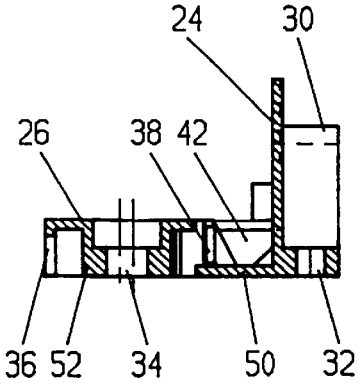
FIG. 3 shows a sectional representation of a holder receptacle of the connecting accessory according to the invention.
Figure 9:
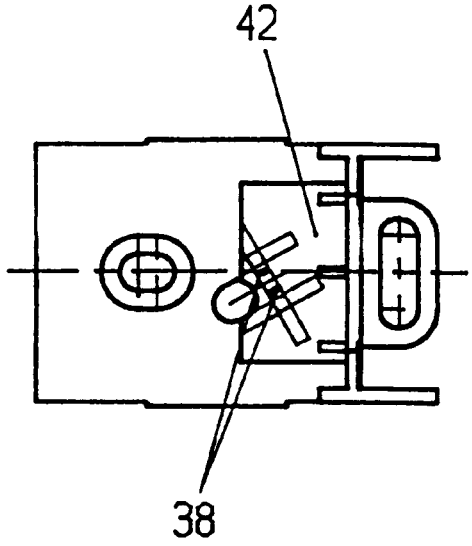

FIG. 3 shows a longitudinal section through the holder receptacle 18. It is seen that means 38 for fixing the electric connecting line 22 in a clamping fashion are arranged inside the base element 26 (see also FIG. 9). In the exemplary embodiment shown, the means 38 comprise two mutually spaced strips. The electric connecting line 22 is guided between said strips, thus producing a firm seating of electric connecting line 22 inside the base element 26 by a corresponding clamping effect. The electric connecting line 22 is guided in this case through a cutout 36 in the base element 26 into the latter. After the connecting line 22 has been appropriately guided further to the strips, the stripped end of the electric connecting line 22 lies in a connecting space 42 constructed in the region of the base element 26 (see also FIG. 9). The ends of the electric connecting line 22 are bent in the direction of the appropriate connecting points for the purpose of connection to the actual lampholder 16.

Also to be seen are two openings 32, 34 for guiding through a mounting element (not represented). These mounting elements are used to mount the connecting accessory 10 or the individual holder receptacle 18 on the mounting surface 12.

Figure 4:
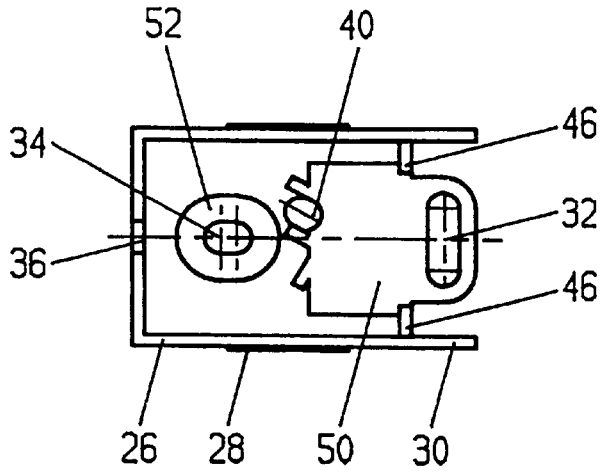
FIG. 4 shows a diagrammatically represented view from below of a holder receptacle of the connecting accessory according to the invention.

FIG. 4 shows a diagrammatically represented view of the holder receptacle 18 from below. The position of the cutouts 36 and 46, which are important for guiding the electric connecting line 22 inside the base element 26, is to be seen. Also to be seen is that the opening 34 is surrounded by a collar 52. Said collar 52 serves to deflect the electric connecting line 22 entering the base element 26 through the cutout 36. At its end constructed in the region of the mounting frame 24, the base element 26 has two lateral stops 30 which serve to stabilize the mounting frame 24. The cutout 40 serves as an insertion aid for the line 22.

The holder 16 inserted into the mounting frame 24 prevents the connecting line 22 clamped into the strips from being able to be loosened inadvertently.

Figure 5:
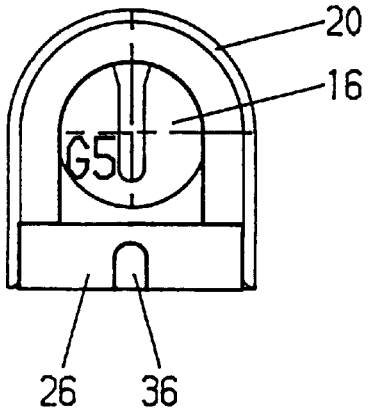
FIG. 5 shows a diagrammatically represented front view of a holder receptacle with housing cover of the connecting accessory according to the invention.

FIG. 5 shows the holder receptacle 18 with the housing cover 20 in a diagrammatically represented front view. In this arrangement, the housing cover 20 surrounds the base element 26 and the mounting frame 24. The lampholder 16 is covered by the housing cover 20.

Figure 6:
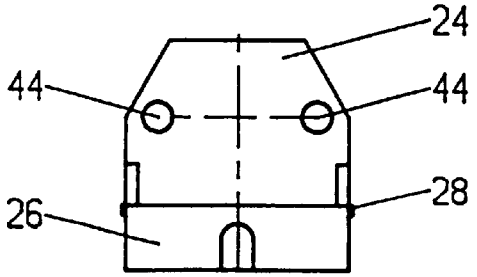
FIG. 6 shows a diagrammatically represented front view of a holder receptacle in accordance with FIGS. 3 and 4 of the connecting accessory according to the invention.
Figure 7:
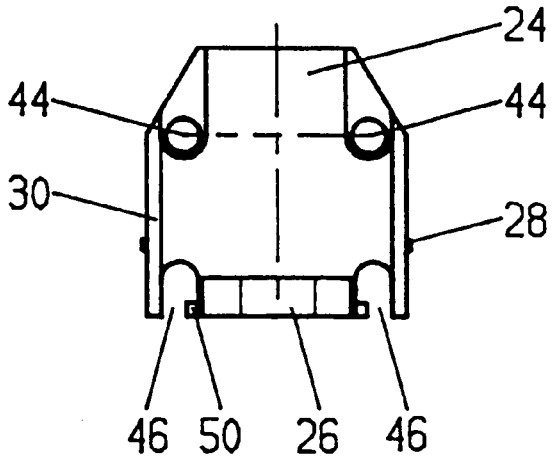
FIG. 7 shows a diagrammatically represented rear view of a holder receptacle in accordance with FIGS. 3 and 4 of the connecting accessory according to the invention.

FIGS. 6 and 7 show the holder receptacle 18 in a front view and rear view, respectively. It is to be seen that the mounting frame 24 has two openings 44 for holding the mounting element on the lampholder 16.

Figure 8A:
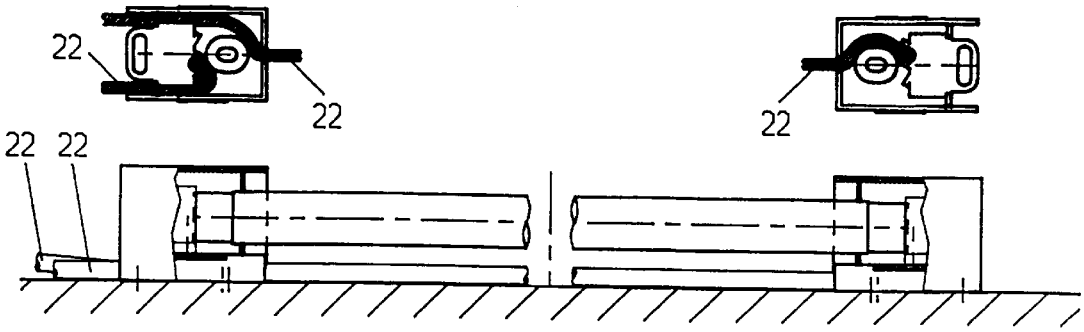
FIGS. 8*a*–8*c* show diagrammatically represented side views of inventive connecting accessories with different guidance of electric connecting lines in each case.
Figure 8B:
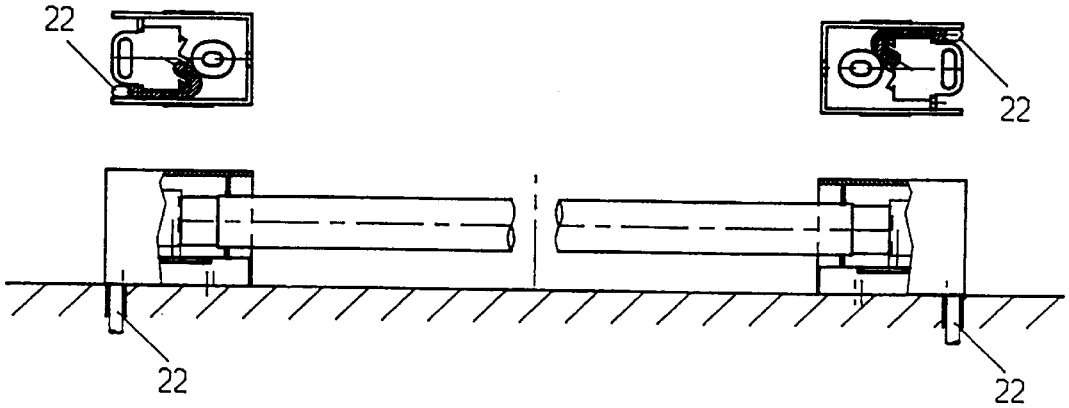
Figure 8C:
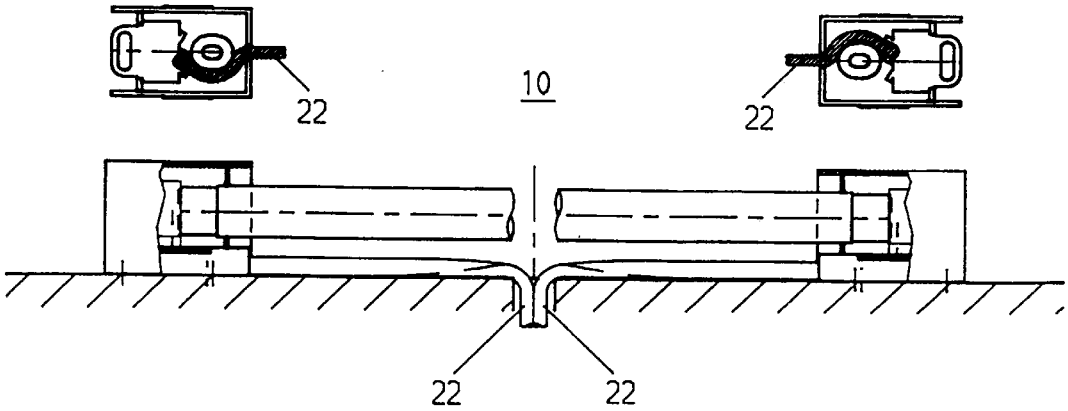

Mounting pins (not represented) of the lampholder 16 are normally guided through said openings 44. It may also be seen that the mounting frame 24 has two further openings 46 which serve the purpose of guiding through electric connecting lines 22. The openings 46 are arranged in this case in the region of the base element 26 or a base plate 50 (see also FIG. 4) of the base element 26 opposite the cutout 36. This results in a multiplicity of possible cable runs, the possibilities for using the connecting accessory 10 thereby being multiplied in turn. Said possibilities are shown by way of example in FIGS. 8*a*–8*c* with the aid of diagrammatically represented side views and bottom views of three connecting accessories 10 with in each case a different guidance of the electric connecting lines 22. A fourth possibility of guidance follows from FIG. 1.

What is claimed is:

1. A connecting accessory for fluorescent lamps, comprising:

two lampholders constructed separately from one another and mutually spaced for holding corresponding connecting ends of the fluorescent lamp, each of the lampholders being arranged in each case in a holder receptacle, said holder receptacle comprising a base element for strain relief of the accessory and a mounting frame for mounting said each of lampholders, said base element and said mounting frame arranged perpendicular to each other, wherein each of the holder receptacles (18) having an integrated device for the strain relief of electric connecting lines (22), said integrated device positioned inside said base element and comprising two mutually spaced strips which by a clamping effect produce a firm seating of the electric connecting lines.

2. The connecting accessory as claimed in claim 1, wherein each of the holder receptacles (18) has a housing cover (20).

3. The connecting accessory as claimed in claim 2, wherein the housing cover (20) is constructed in such a way that it covers the lampholder (16) and a lamp base (17).

4. The connecting accessory as claimed in claim 1, wherein the electric connecting lines (22) have double insulation.

5. The connecting accessory as claimed in claim 1, wherein the holder receptacle (18) has at least two openings or cutouts (36, 46) for holding the electric connecting line or connecting lines (22), the cutouts (36, 46) being constructed next to one another and opposite one another.

6. The connecting accessory as claimed in claim 1, wherein the electric connecting lines (22) have reinforced insulation.

7. The connecting accessory as claimed in claim 1, wherein the holder receptacle (18) has at least two openings or cutouts (36, 46) for holding the electric connecting line or connecting lines (22), the cutouts (36, 46) being constructed next to one another.

8. The connecting accessory as claimed in claim 1, wherein the holder receptacle (18) has at least two openings or cutouts (36, 46) for holding the electric connecting line or connecting lines (22), the cutouts (36, 46) being constructed opposite one another.

* * * * *